US012396615B2

(12) United States Patent
Wang

(10) Patent No.: US 12,396,615 B2
(45) Date of Patent: Aug. 26, 2025

(54) HEAT PUMP DISHWASHER

(71) Applicants: Guangdong Midea White Home Appliance Technology Innovation Center Co., Ltd., Foshan (CN); Midea Group Co., Ltd., Foshan (CN); GD Midea Air-Conditioning Equipment Co., Ltd., Foshan (CN)

(72) Inventor: Wenpeng Wang, Foshan (CN)

(73) Assignees: Guangdong Midea White Home Appliance Technology Innovation Center Co., Ltd., Foshan (CN); Midea Group Co., Ltd., Foshan (CN); GD Midea Air-Conditioning Equipment Co., Ltd., Foshan (CN)

( * ) Notice: Subject to any disclaimer, the term of this patent is extended or adjusted under 35 U.S.C. 154(b) by 171 days.

(21) Appl. No.: 18/369,641

(22) Filed: Sep. 18, 2023

(65) Prior Publication Data

US 2024/0000291 A1 Jan. 4, 2024

Related U.S. Application Data

(63) Continuation of application No. PCT/CN2022/138792, filed on Dec. 13, 2022.

(30) Foreign Application Priority Data

Feb. 18, 2022 (CN) ..... 202210155263.4

(51) Int. Cl.

| | |
|---|---|
| ***A47L 15/14*** | (2006.01) |
| ***A47L 15/42*** | (2006.01) |
| ***F24H 4/02*** | (2022.01) |

(52) U.S. Cl.

CPC ..... *A47L 15/4291* (2013.01); *A47L 15/14* (2013.01); *A47L 15/42* (2013.01); *A47L 15/4212* (2013.01);

(Continued)

(58) Field of Classification Search

None

See application file for complete search history.

(56) References Cited

U.S. PATENT DOCUMENTS

| | | | |
|---|---|---|---|
| 5,678,421 | A | 10/1997 | Maynard et al. |
| 2020/0163528 | A1 | 5/2020 | Yoon et al. |
| 2020/0163530 | A1 | 5/2020 | Yoon et al. |

FOREIGN PATENT DOCUMENTS

| | | | |
|---|---|---|---|
| CN | 201262505 | Y | 6/2009 |
| CN | 202613754 | U | 12/2012 |

(Continued)

OTHER PUBLICATIONS

Midea Group Co., Ltd., WO, PCT/CN2022/138792, Mar. 8, 2023, 4 pgs.

(Continued)

*Primary Examiner* — Levon J Shahinian

(74) *Attorney, Agent, or Firm* — Morgan, Lewis & Bockius LLP

(57) ABSTRACT

A heat pump dishwasher includes a chassis and a heat pump system. A liquid collecting groove is provided at an upper side of the chassis. The heat pump system includes an evaporator and a compressor, both the evaporator and the compressor are installed at the chassis, and the compressor is installed at the liquid collecting groove. Condensed water may be collected, and condensation water may be avoided in the liquid collecting groove and may reduce the corrosion of the liquid collecting groove and may reduce interruptions to the operation of electrical components.

12 Claims, 7 Drawing Sheets

(52) U.S. Cl.
CPC ..... *A47L 15/4217* (2013.01); *A47L 15/4223* (2013.01); *A47L 15/4225* (2013.01); *A47L 15/4251* (2013.01); *A47L 15/4272* (2013.01); *A47L 15/4285* (2013.01); *F24H 4/02* (2013.01)

(56) References Cited

FOREIGN PATENT DOCUMENTS

| | | | |
|---|---|---|---|
| CN | 106580219 | A | 4/2017 |
| CN | 106606342 | A | 5/2017 |
| CN | 108185954 | A | 6/2018 |
| CN | 108670162 | A | 10/2018 |
| CN | 109620083 | A | 4/2019 |
| CN | 109691953 | A | 4/2019 |
| CN | 109938656 | A | 6/2019 |
| CN | 110251017 | A | 9/2019 |
| CN | 111110155 | A | 5/2020 |
| CN | 210673257 | U | 6/2020 |
| CN | 212326319 | U | 1/2021 |
| CN | 113243867 | A | 8/2021 |
| CN | 215687614 | U | 2/2022 |
| CN | 114431805 | A | 5/2022 |
| EP | 2682037 | A2 | 1/2014 |
| EP | 2697579 | B1 | 7/2015 |
| EP | 2678623 | B1 | 11/2019 |
| EP | 2443983 | B1 | 6/2020 |
| JP | H 04260776 | A | 9/1992 |
| JP | 2004125241 | A | 4/2004 |
| JP | 2005098627 | A | 4/2005 |
| KR | 20200064266 | A | 6/2020 |
| WO | WO 2019034370 | A1 | 2/2019 |
| WO | WO 2020069802 | A1 | 4/2020 |

OTHER PUBLICATIONS

Midea Group Co., Ltd., IPRP, PCT/CN2022/138792, Aug. 20, 2024, 5 pgs.

Midea Group Co., Ltd., Chinese Office Action, CN Patent Application No. 202210155263.4, May 30, 2024, 6 pgs.

Midea Group Co., Ltd., Extended European Search Report, EP Patent Application No. 22924584.0, Jul. 16, 2024, 9 pgs.

Midea Group Co., Ltd., Isr, PCT/CN2022/138792, Mar. 8, 2023, 3 pgs.

Midea Group Co., Ltd., First Chinese Office Action, CN Patent Application No. 202210155263.4, Mar. 29, 2024, 12 pgs.

Midea Group Co., Ltd., Second Chinese Office Action, CN Patent Application No. 202210155263.4, May 1, 2024, 14 pgs.

Dong Wei et al., "Economics and Environmental Protection Benefits Analysis of Multi-Functional Heat Pump Dishwasher", E3S Web Conferences, Refrigerator and Air-Conditioning, vol. 18, No. 10, Oct. 2018, 12 pgs.

Peder Bengtsson et al., "A Household Dishwasher Heated by a Heat Pump System Using an Energy Storage Unit with Water as the Heat Source", International Journal of Refrigeration, Oct. 2014, 10 pgs.

HEAT PUMP DISHWASHER

CROSS-REFERENCE TO RELATED APPLICATIONS

This application is a continuation of International Patent Application No. PCT/CN2022/138792, filed on Dec. 13, 2022, which claims priority to Chinese Patent Application No. 202210155263.4, filed on Feb. 18, 2022, the entire contents of which are incorporated herein by reference.

TECHNICAL FIELD

The present application relates to the technical field of kitchen appliances, in particular to a heat pump dishwasher.

BACKGROUND

The heat pump dishwasher includes a washing cavity and an installation cavity. The washing cavity is used for holding the tableware to be washed, and the installation cavity is used for holding the electrical elements. Heat transmission usually occurs when the heat pump dishwasher operates, and the water vapor of the air in the installation cavity will be liquefied into the condensed water during the heat transmission. Thus, when a lot of condensed water gathers in the installation cavity, the installation cavity may rust or the operation of the electrical components may be affected, resulting in potential safety hazards.

SUMMARY

In some embodiments, the present application provides a heat pump dishwasher including a chassis and a heat pump system.

A liquid collecting groove is provided at an upper side of the chassis.

The heat pump system includes an evaporator and a compressor, both the evaporator and the compressor are installed at the chassis, and the compressor is installed at the liquid collecting groove.

In some embodiments, a supporting member is provided at a bottom of the liquid collecting groove, and the supporting member is configured to support the compressor to make the compressor spaced apart from the bottom of the liquid collecting groove.

In some embodiments, a distance between the compressor and the bottom of the liquid collecting groove is L1, and L1 is greater than 0 mm and is not greater than 5 mm.

In some embodiments, the chassis includes a liquid storage box, the liquid storage box includes a box body with an opening facing upward and a cover body for covering the opening, the cover body is partially concave to form the liquid collecting groove, the evaporator is installed inside the box body, the compressor is located outside the box body, and heat transfer fluid is stored in the box body.

In some embodiments, an initial liquid level of the heat transfer fluid in the box body is not higher than a lowest point of the cover body.

In some embodiments, an overflow port is provided at the liquid storage box, and the overflow port is higher than a lowest point of the cover body.

In some embodiments, the overflow port is provided at a side wall surface of the box body.

In some embodiments, the heat pump dishwasher further includes a washing box body, and at least part of the washing box body is supported by an upper end surface of the cover body.

In some embodiments, a sealing ring is provided between a lower end surface of the cover body and the box body.

In some embodiments, the washing box body is installed at the upper end surface of the cover body through an installation structure, the installation structure includes a supporting portion extending upward from the cover body, and an upper end of the supporting portion is configured to abut against the washing box body, to allow an installation gap formed between the washing box body and the cover body, and the compressor is located in the installation gap.

In some embodiments, the installation structure further includes a connection portion extending vertically, and both ends of the connection portion are respectively connected to a side wall of the washing box body and the supporting portion.

In some embodiments, a guiding structure is provided between the washing box body and the supporting portion. The guiding structure includes a guiding portion extending vertically and a matching portion matched with the guiding portion. One of the guiding portion and the matching portion is provided at the washing box body, and the other one of the guiding portion and the matching portion is provided at the supporting portion.

In some embodiments, the guiding portion is a guiding column, and the matching portion is a guiding hole matched with the guiding portion.

In some embodiments, a bottom of the washing box body is provided with a drainage groove, the heat pump dishwasher further includes a washing system, and the washing system includes a water inlet flow path provided in the installation gap, a water inlet of the water inlet flow path communicates with the drainage groove, a water outlet of the water inlet flow path communicates with a spray arm provided in the washing box body, and a circulation water pump is provided at the water inlet flow path, the heat pump system further includes a condenser provided at the water inlet flow path, the condenser includes a water inlet pipe, the water inlet pipe includes a condensate water inlet and a condensate water outlet, the condensate water inlet is lower than the condensation water outlet, and the condenser is located between the drainage groove and the circulation water pump, and a bottom of the drainage groove is lower than the condensation water inlet, and the condensation water outlet is lower than a circulation water inlet of the circulation water pump.

In some embodiments, the washing system further includes a drainage flow path provided at the installation gap, a drainage pump is provided at the drainage flow path, a drainage inlet of the drainage flow path communicates with the drainage groove, the drainage inlet is lower than the condensation water inlet, and the drainage outlet of the drainage flow path communicates with a drainage pipe.

In the present application, the heat pump dishwasher includes a chassis and a heat pump system, and a liquid collecting groove is provided at an upper side of the chassis. The heat pump system includes an evaporator and a compressor, both the evaporator and the compressor are installed at the chassis, and the compressor is installed at the liquid collecting groove. Not only the condensed water can be collected, but also the condensed water in the liquid collecting groove will be evaporated due to the heat released by the compressor during the operation process, which can avoid that the condensation water exists in the liquid collecting groove for a long time to cause the corrosion of the liquid collecting groove and affect the operation of electrical components. In addition, heat is absorbed during the evaporation process of the condensed water, which can take away the heat of the compressor and cool the compressor.

BRIEF DESCRIPTION OF THE DRAWINGS

To illustrate the technical solutions according to the embodiments of the present application or the related art more clearly, the accompanying drawings for describing the embodiments or the related art are introduced briefly in the following. Apparently, the accompanying drawings in the following description are only some embodiments of the present application. Persons skilled in the art can derive other drawings from the structures of the accompanying drawings without creative efforts.

DESCRIPTION OF REFERENCE NUMBERS

Figure 1:
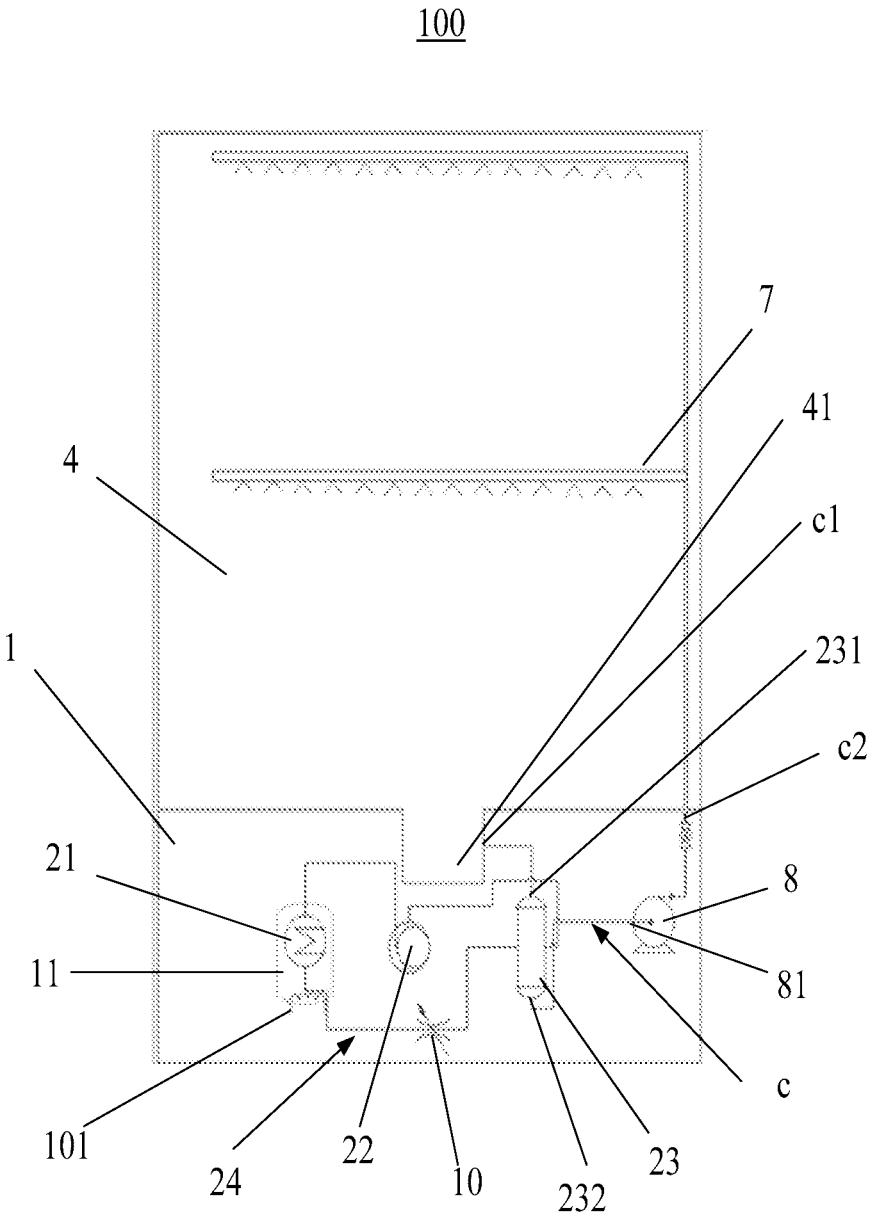
FIG. 1 is a structural schematic view of a heat pump dishwasher according to some embodiments of the present application.

| Reference number | Name | Reference number | Name |
|---|---|---|---|
| 100 | heat pump dishwasher | 51 | supporting portion |
| 1 | chassis | 52 | connection portion |
| 11 | liquid storage box | 61 | guiding portion |
| 111 | box body | 62 | matching portion |
| 112 | cover body | 7 | spray arm |
| 1121 | protruding column | 8 | circulation water pump |
| 113 | overflow port | 81 | circulation water inlet |
| 21 | evaporator | 9 | drainage pump |
| 211 | evaporator core pipe | 10 | throttling device |
| 2111a | refrigerant inlet | 101 | heating assembly |
| 2111b | refrigerant outlet | 102 | water softener |
| 212 | heat transfer fin | a | liquid collecting groove |
| 22 | compressor | b | installation gap |
| 23 | condenser | c | water inlet flow path |
| 231 | condensate water inlet | c1 | water inlet |
| 232 | condensate water outlet | c2 | water outlet |
| 24 | refrigerant circulation flow path | d | drainage flow path |
| 3 | sealing ring | d1 | drainage inlet |
| 4 | washing box body | d2 | drainage outlet |
| 41 | drainage groove | | |

The realization of the objective, functional characteristics, and advantages of the present application are further described with reference to the accompanying drawings.

DETAILED DESCRIPTION OF THE EMBODIMENTS

The technical solutions of the embodiments of the present application will be described clearly in the following with reference to the accompanying drawings of the embodiments of the present application. It is obvious that the embodiments described are only some rather than all of the embodiments of the present application. Based on the embodiments of the present application, all other embodiments obtained by those skilled in the art without creative efforts shall fall within the scope of the present application.

It should be noted that all the directional indications (such as up, down, left, right, front, rear . . . ) in the embodiments of the present application are only used to explain the relative positional relationship, movement, or the like of the components in a certain posture (as shown in the drawings). If the specific posture changes, the directional indication will change accordingly.

Besides, the descriptions associated with, e.g., "first" and "second," in the present application are merely for descriptive purposes, and cannot be understood as indicating or suggesting relative importance or impliedly indicating the number of the indicated technical feature. Therefore, the feature associated with "first" or "second" can expressly or impliedly include at least one such feature. In addition, the meaning of "and/or" in the whole text includes three parallel solutions. Taking "A and/or B" as an example, it includes solution A, solution B, or solutions in which A and B are satisfied at the same time. Besides, the technical solutions of the various embodiments can be combined with each other, but the combinations must be based on the realization of those skilled in the art. When the combination of technical solutions is contradictory or cannot be achieved, it should be considered that such a combination of technical solutions does not exist, nor does it fall within the scope of the present application.

The heat pump dishwasher includes a washing cavity and an installation cavity. The washing cavity is used for holding the tableware to be washed, and the installation cavity is used for holding the electrical elements. Heat transmission usually occurs when the heat pump dishwasher operates, and the water vapor of the air in the installation cavity will be liquefied into the condensed water during the heat transmission. Thus, when a lot of condensed water gathers in the installation cavity, the installation cavity will rust or the operation of the electrical components will be affected, resulting in potential safety hazard.

In view of this, the present application provides a heat pump dishwasher, aiming to solve the problem in the existing technology that when a lot of condensed water gathers in the installation cavity, the installation cavity will rust or the operation of the electrical components will be affected, resulting in potential safety hazard. FIG. 1 to FIG. 9 are structural schematic views of a heat pump dishwasher according to embodiments of the present application.

As shown in FIG. 1 to FIG. 5, the heat pump dishwasher 100 of the present application includes a chassis 1 and a heat pump system. A liquid collecting groove a is provided at an upper side of the chassis 1. The heat pump system includes an evaporator 21 and a compressor 22. The evaporator 21 and the compressor 22 are installed at the chassis 1, and the compressor 22 is installed at a position corresponding to the liquid collecting groove a.

In this application, since the evaporator 21 is at a low temperature when the heat pump system operates, the evaporator 21 is used as a cold source. The evaporator 21 is installed at the chassis 1, so that the cold energy of the evaporator 21 will be transmitted to the chassis 1 during the heat transmission process. In this case, the surface temperature of the chassis 1 will decrease, and condensed water will be generated when the surface of the chassis 1 contacts with air. The condensed water condensed at the upper side of the chassis 1 can gather in the liquid collecting groove a, and the condensed water in the liquid collecting groove a can be evaporated due to the heat released by the compressor 22 installed at the liquid collecting groove a during the operation process, which can not only collect the condensed water, but also can avoid that the condensation water exists in the liquid collecting groove a for a long time to cause the corrosion of the liquid collecting groove a and affect the operation of electrical components. In addition, heat is absorbed during the evaporation process of the condensed water, which can take away the heat of the compressor 22 and cool the compressor 22.

Figure 3:
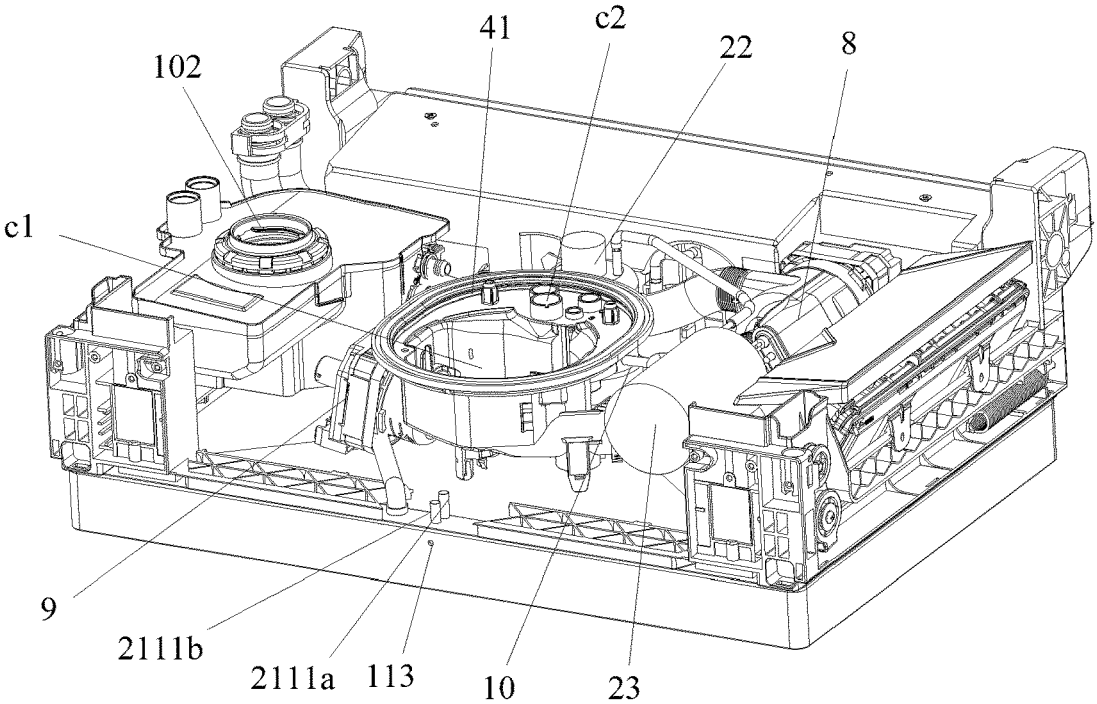
FIG. 3 is a structural schematic view of the heat pump dishwasher (partial structure) in FIG. 2.
Figure 4:
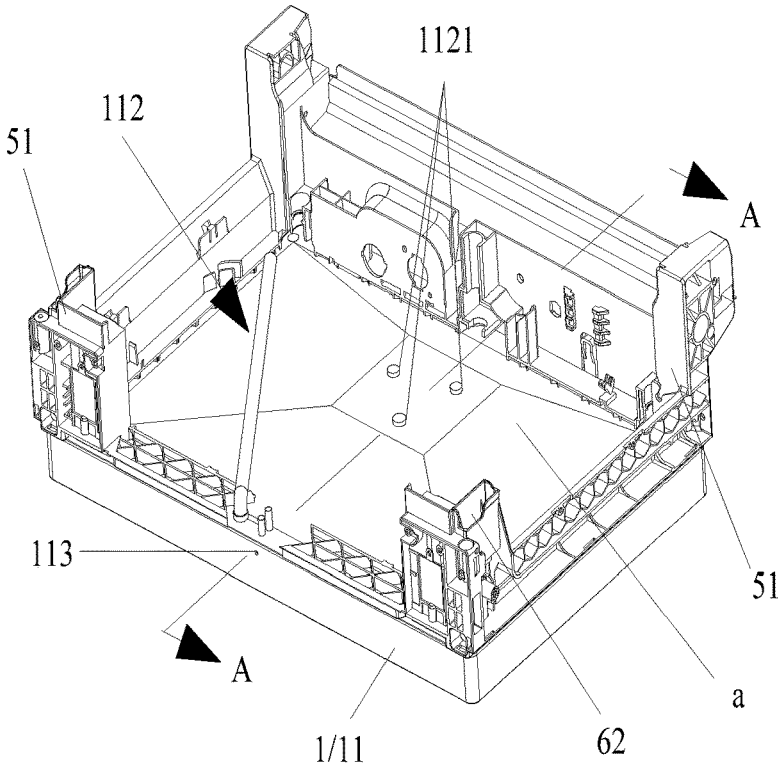
FIG. 4 is a three-dimensional structural schematic view of a chassis of the heat pump dishwasher in FIG. 2.

As shown in FIG. 3 and FIG. 4, in some embodiments of the present application, a supporting member is provided at a bottom of the liquid collecting groove a, and the supporting member is configured to support the compressor 22 to make the compressor 22 spaced apart from the bottom of the liquid collecting groove a. In this way, a dead angle, that is located in the contact position between the compressor 22 and the bottom of the liquid collecting groove a and caused by the direct contact between the compressor 22 and the bottom of the liquid collecting groove a, can be avoided. This dead angle may not only make it inconvenient to clean the contact position between the compressor 22 and the bottom of the liquid collecting groove a, but also make it inconvenient to disassemble and assemble the compressor 22 when the compressor 22 is to be repaired. Further, this dead angle will cause the bottom of the liquid collecting groove a and the bottom of the compressor 22 to have a risk of corrosion after a long period of use.

It should be noted that there are many ways to install the compressor 22 at the liquid collecting groove a. For example, the compressor 22 may be provided with an installation seat, and the installation seat may be connected with the bottom of the liquid collecting groove a through a buckle structure, a threaded connection structure, etc., which will not be limited in the present application.

Figure 5:
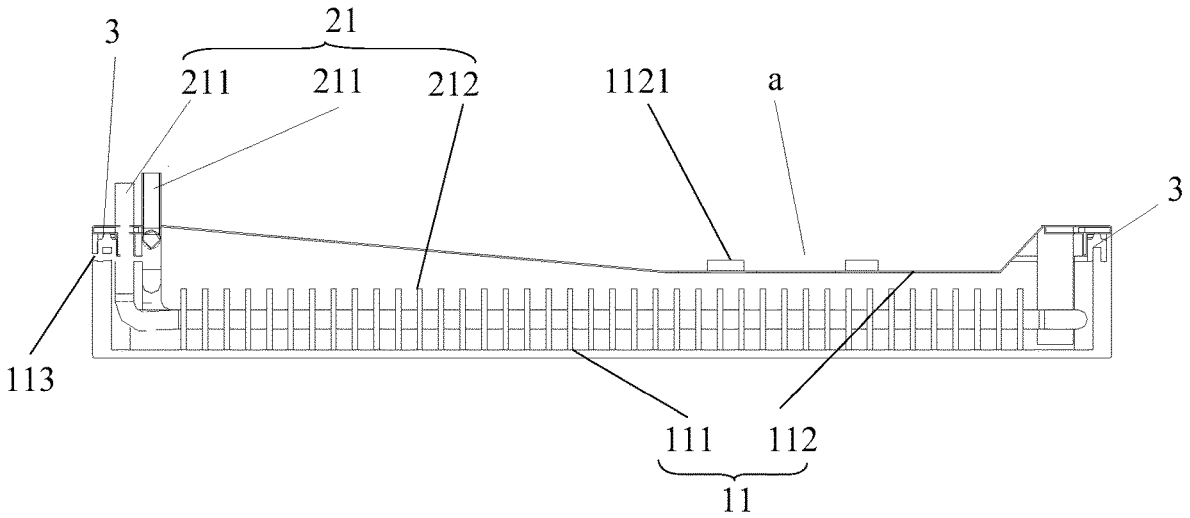
FIG. 5 is a schematic cross-sectional view along A-A in FIG. 4.

As shown in FIG. 4 and FIG. 5, in some embodiments, the supporting member includes a plurality of protruding columns 1121 protruding from the bottom of the liquid collecting groove a, and the plurality of protruding columns 1121 support the compressor 22, so that there is a gap between the compressor 22 and the bottom of the liquid collecting groove a. In addition, the compressor 22 is installed at the plurality of protruding columns 1121 through the threaded connection structure, which may not only realize the installation of the compressor 22, but also make the compressor 22 detachably connected to the cover body 112. In this way, it is easy to maintain and clean the compressor 22, the operation is easy, and the connection is firm.

It should be noted that, considering that the compressor 22 will vibrate during operation, the supporting member is made of the elastic material, and the elastic deformation of the elastic material can offset the vibration of the compressor 22 with good effect. Specifically, the supporting material of the supporting member may be rubber, silica gel, etc., which is not limited in this application.

Since the way of removing the condensed water is to remove the condensed water gathering in the liquid collecting groove a via heat generated in the operation of the compressor 22, the distance between the compressor 22 and the bottom of the liquid collecting groove a cannot be too far, otherwise the condensed water in the liquid collecting groove a cannot be completely removed. Therefore, the distance between the compressor 22 and the bottom of the liquid collecting groove a is defined to be L1, and L1 is greater than 0 mm and not greater than 5 mm. Within this range, heat generated in the operation of the compressor 22 can completely evaporate the condensed water in the liquid collecting groove a, thereby improving the service life of the heat pump dishwasher 100, and facilitating the installation of the compressor 22.

In the current process of absorbing the cooling energy of the evaporator 21 through air cooling, there is a problem of noise. Therefore, as shown in FIG. 3 and FIG. 5, in some embodiments of the present application, the chassis 1 includes a liquid storage box 11, and the liquid storage box 11 includes a box body 111 with an opening facing upwards and a cover body 112 for covering the opening. The cover body 112 is partially concave to form the liquid collecting groove a, and the evaporator 21 is installed inside the box body 111. The compressor 22 is located outside the box body 111, and the box body 111 stores heat transfer fluid, so that heat transfer between the evaporator 21 in the box body 111 and the heat transfer fluid stored in the box body 111 can be realized via the natural flow of the heat transfer fluid. Therefore, the evaporator 21 can transmit the generated cold energy to the heat transfer fluid without parts such as fans or water pumps, and there is almost no noise in the working process, and the effect is good.

Moreover, since both the evaporator 21 and the heat transfer fluid are provided in the box body 111, the heat pump dishwasher 100 has a compact structure, and the volume of the heat pump dishwasher 100 is reduced. In addition, since the evaporator 21 and the compressor 22 are respectively provided on both sides of the cover body 112, the cold energy released by the evaporator 21 is first transmitted to the heat transfer fluid, and the cold energy in addition to the part stored in the heat transfer fluid will be transmitted to the liquid storage box 11. Since the cover body 112 of the liquid storage box 11 is provided with electrical elements, to prevent the large amount of condensed water accumulated on the cover body 112 from overflowing, affecting the operation of the electrical elements and even causing safety hazards, the condensed water on the cover body 112 is accumulated in the liquid collecting groove a, and the condensed water in the liquid collecting groove a will be removed via the heat released by the compressor 22. In addition, heat is absorbed during the evaporation process of the condensed water, so that the heat of the compressor 22 can be better taken away, and the temperature of the compressor 22 can be lowered. Since the liquid storage box is provided on the chassis 1, the height of the heat pump dishwasher 100 decreases, the weight of the chassis 1 of the heat pump dishwasher 100 increases, and the center of gravity of the heat pump dishwasher 100 decreases, which will increase the structural stability of the heat pump dishwasher 100.

It should be noted that, in some embodiments, the heat transfer fluid is used to absorb the cooling energy released by the evaporator, that is, to transfer heat with the evaporator. Since there are many types of heat transfer fluid, the heat transfer fluid in this application is preferably liquid at normal temperature (generally 10° C.-25° C.) and solid at low temperature (generally below 10° C.). That is, the heat transfer fluid will undergo a phase change during the process of absorbing the cooling energy of the evaporator, and the process of changing from liquid to solid absorbs a lot of cooling energy of the evaporator 21. Specifically, the heat transfer fluid can be a mixture composed of inorganic salt, water, coagulant, stabilizer and thickener, and can also be an aqueous solution of inorganic salt, water, etc. When the heat transfer fluid is water, the heat transfer fluid inlet of the box body 111 may communicate with the water supply device for adding water to the box body 111, so that the heat transfer fluid outlet of the box body 111 communicates with the drain pump for drainage.

Figure 6:
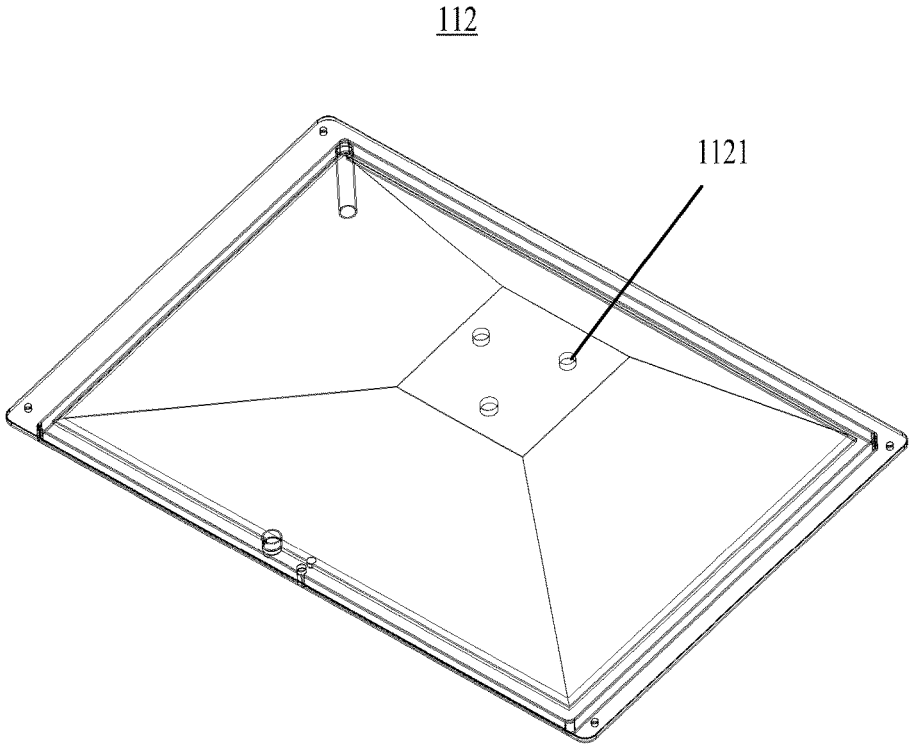
FIG. 6 is a structural schematic view of a cover body in FIG. 2.

Further, as shown in FIG. 4 to FIG. 6, the side wall of the liquid collecting groove a is inclined, so that the condensed water generated from the condensation of water vapor in the air can flow to the bottom of the liquid collecting groove a along the side wall, and then may gather at the bottom of the liquid collecting groove a, so that the condensed water can be evaporated and removed via the heat of the compressor 22.

Specifically, the initial liquid level of the heat transfer fluid stored in the box body 111 is not higher than the lowest point of the cover body 112. Considering that the phase will change in the process that the heat transfer fluid absorbs the cooling energy released by the evaporator 21, that is, the heat transfer fluid will change from liquid to solid, leading the volume to expand, the initial liquid level of the heat transfer fluid is not higher than the lowest point of the cover body 112, so that a gap will exist between the liquid level of the heat transfer fluid and the cover body 112, which allows a space for volume expansion during the phase change process and avoids deformation of the box body 111 due to volume expansion.

As shown in FIG. 3 and FIG. 5, the liquid storage box 11 is provided with an overflow port 113, so that the box body 111 communicates with the outside atmosphere. Since the volume of the heat transfer fluid will change after the phase changes, when the volume reduces, the external air enters the box body 111 via the overflow port 113 to form a balance of internal and external air pressure. When the volume expands, its solid state expands to the surroundings, which will squeeze the box body 111, and the excess air in the box body 111 will be discharged via the overflow port 113, thus, a balance of internal and external air pressure will form to avoid deformation of the liquid storage box 11. The overflow port 113 is higher than the lowest point of the cover body 112, which also avoids excessive overflow of the heat transfer fluid and effects on the subsequent use.

Specifically, as shown in FIG. 3 and FIG. 5, in some embodiments of the present application, the overflow port 113 is provided at the side wall of the box body 111, so that when the heat transfer fluid stored in the box body 111 overflows, the heat transfer fluid can directly overflow to the outside of the heat pump dishwasher 100, which is convenient for cleaning and avoids potential safety hazards.

Figure 2:
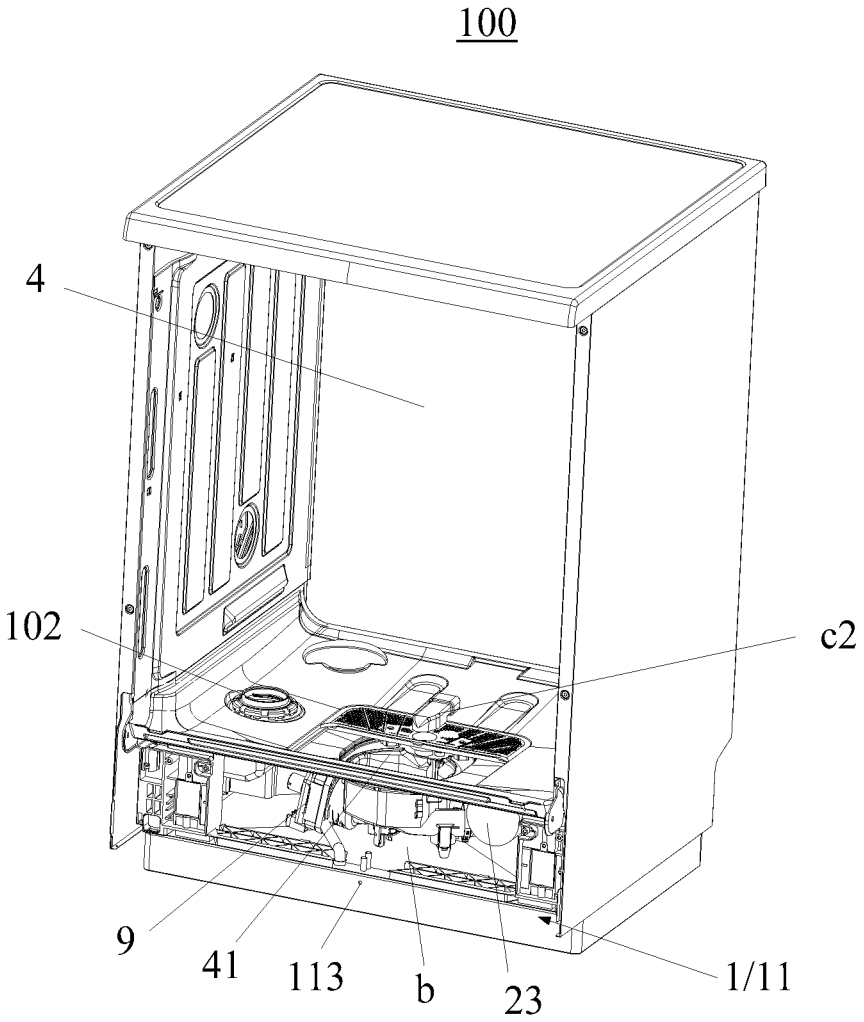
FIG. 2 is a three-dimensional structural schematic view of the heat pump dishwasher (from one perspective) in FIG. 1.
Figure 7:
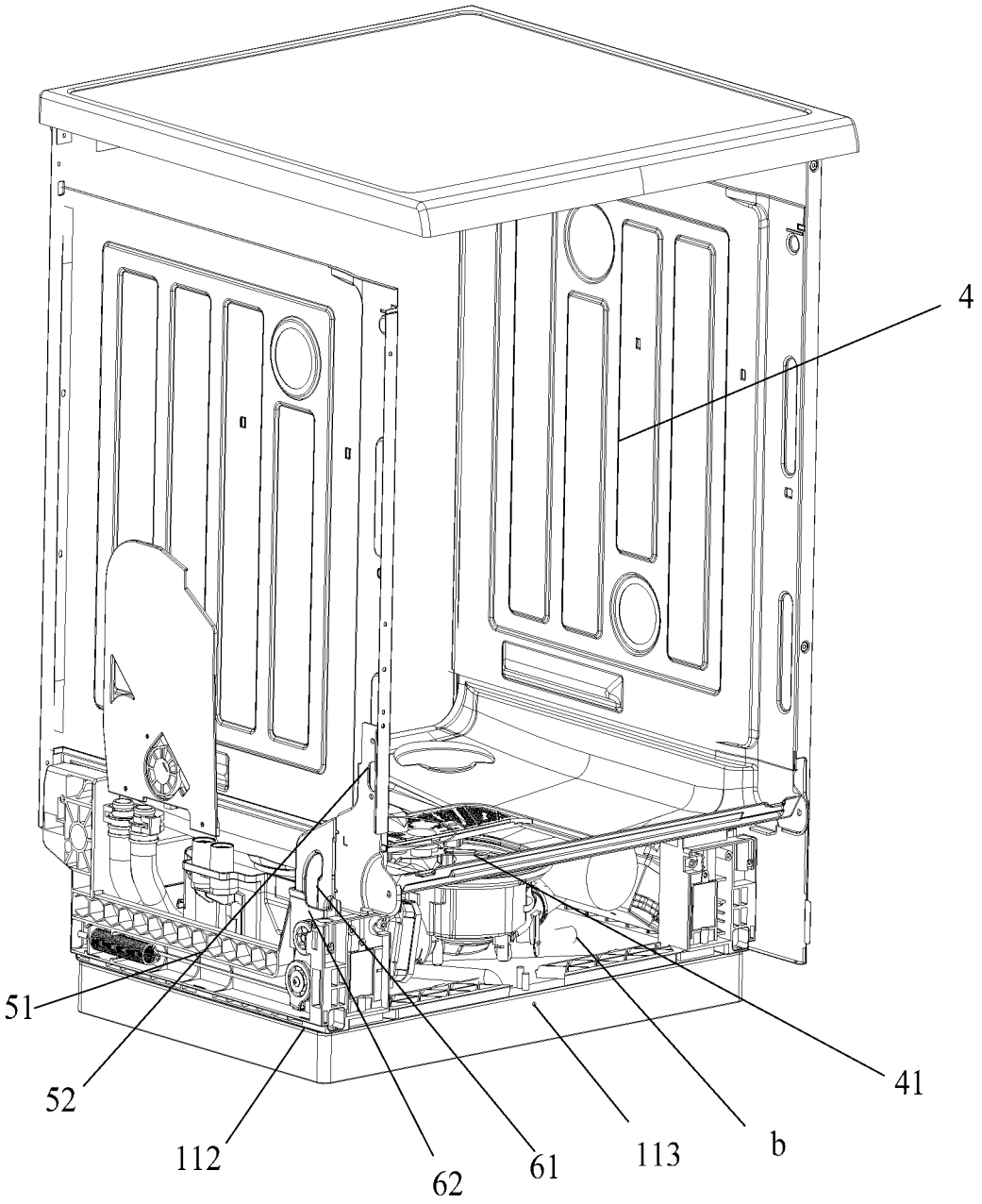
FIG. 7 is a three-dimensional structural schematic view of the heat pump dishwasher (from another perspective) in FIG. 2.

As shown in FIG. 2 and FIG. 7, the heat pump dishwasher 100 also includes a washing box body 4, and at least part of the washing box body 4 is supported by an upper end surface of the cover body 112. In this way, the washing box body 4 will press the cover body 112 and the box body 111 tightly, so that the weight carried by the cover body 112 is evenly distributed around the box body, and there is a uniform seal between the box body 111 and the cover body 112. Thus, when the heat transfer fluid is stored in the box body 111, leakage of the heat transfer fluid can be effectively prevented.

Further, to improve the sealing between the cover body 112 and the box body 111, as shown in FIG. 5, a sealing ring 3 is provided between the lower end surface of the cover body 112 and the box body 111. Since the washing box body 4 is supported by the cover body 112, the sealing ring 3 can better seal the gap between the lower end surface of the cover body 112 and the box body 111, which can improve the sealing between the cover body 112 and the box body 111 and prevent the heat transfer fluid from overflowing, and the effect is good.

Specifically, as shown in FIG. 4 and FIG. 7, the washing box body 4 is installed at the upper end surface of the cover body 112 through an installation structure, and the installation structure includes a supporting portion 51 extending upward from the cover body 112. The upper end of the supporting portion 51 abuts against the washing box body 4 to allow an installation gap formed between the washing box body 4 and the cover body 112, and the compressor 22 is located in the installation gap b, which can realize the installation of the compressor 22, so that the heat pump dishwasher 100 has a compact structure.

It should be noted that there are many ways to install the washing box body 4 at the upper end surface of the cover body 112. For example, an installation protrusion and an installation groove matched with the installation protrusion can be provided between the washing box body 4 and the cover body 112. The installation protrusion extends along the periphery of the cover body 112. In this way, the installation protrusion is matched with the installation groove, and the installation protrusion is locked and fixed in the installation groove through the threaded structure, so that an installation gap b is formed between the washing box body 4 and the cover body 112. The compressor 22 is located in the installation gap b, which not only may realize the installation of the compressor 22, but also may make the heat pump dishwasher 100 have a compact structure.

Further, as shown in FIG. 4 and FIG. 7, the supporting portion 51 extends along the periphery of the cover body 112, so that when the washing box body 4 is supported by the supporting portion 51, the pressure on the cover body 112 from the washing box body 4 is evenly distributed on the periphery of the cover body 112 to improve the sealing effect.

To fix the washing box body 4 to the cover body 112, as shown in FIG. 4 and FIG. 7, the installation structure further includes a connection portion 52, and the connection portion 52 extends vertically. One end of the connection portion 52 is connected to the side wall of the washing box body 4, and the other end of the connection portion 52 is connected to the supporting portion 51, so that the washing box body 4 is connected and fixed to the cover body 112, and the structure is easy for installation.

To avoid the misalignment when the washing box body 4 is installed at the cover body 112, as shown in FIG. 7, a guiding structure is provided between the washing box body 4 and the supporting portion 51. The guiding structure includes a guiding portion 61 extending vertically and a matching portion 62 matched with the guiding portion 61. One of the guiding portion 61 and the matching portion 62 is provided at the washing box body 4, and the other one of the guiding portion 61 and the matching portion 62 is provided at the supporting portion 51. The guiding portion 61 and the matching portion 62 are in a matching installation, to guide the installation of the washing box body 4, so that the washing box body 4 can be accurately installed at the cover body 112, which is easy to operate.

There are many types of the guiding portion 61 and the matching portion 62. For example, the guiding portion 61 and the matching portion 62 can be set as a guiding groove and a guiding protrusion matched with the guiding groove. In some embodiments of the present application, the guiding portion 61 is a guiding column, and the matching portion 62 is a guiding hole matched with the guiding portion 61. The guiding column and the guiding hole are in a matching installation, which can guide and support the washing box body 4, to make the installation of the washing box body 4 stable.

Figure 8:
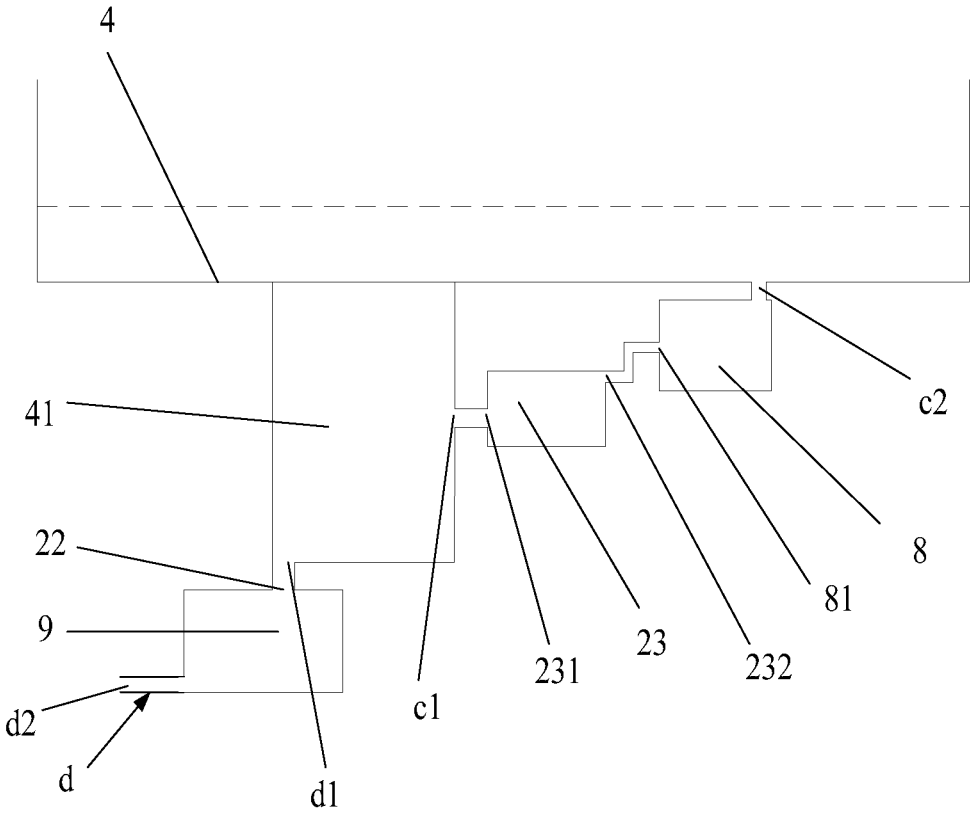
FIG. 8 is a schematic view showing the positional arrangement relationship between a drainage groove, a condenser, a circulation water pump and a drainage pump in FIG. 2.

Specifically, the bottom of the washing box body 4 is provided with a drainage groove 41. As shown in FIG. 1 to FIG. 3, the heat pump dishwasher 100 further includes a washing system, and the washing system includes a water inlet flow path provided in the installation gap b. A water inlet c1 of the water inlet flow path c communicates with the drainage groove 41, and a water outlet c2 of the water inlet flow path c communicates with a spray arm 7 provided in the washing box body 4. A circulation water pump 8 is provided at the water inlet flow path c. The heat pump system further includes a condenser 23 provided at the water inlet flow path c, and the condenser 23 includes a water inlet pipe. The water inlet pipe includes a condensate water inlet 231 and a condensate water outlet 232, and the condensate water inlet 231 is lower than the condensation water outlet 232. The condenser 23 is located between the drainage groove 41 and the circulation water pump 8. In this way, when the spray arm 7 is to spay water to the washing box body 4, the washing water will first enter the washing box body 4, and fills the drainage groove 41. Then the water in the drainage groove 41 will flow along the water inlet flow path c and pass through the condenser 23 and the circulation water pump 8 in turn. After that, the washing water is heated by the condenser 23, and then the washing water is pumped into the spray arm 7 by the circulation water pump 8 to wash the tableware in the washing box body 4. Since the bottom of the drainage groove 41 is lower than the condensation water inlet 231 of the condenser 23 and the condensation water outlet 232 of the condenser 23 is lower than a circulation water inlet 81 of the circulation water pump 8 (as shown in FIG. 8), the condenser 23 can be filled with water to avoid air in the condenser 23. In addition, even if there is air in the condenser 23, the air can be discharged through the circulation water pump 8 and the spray arm 7, and the effect is good.

It should be noted that, in the above embodiments, the driving force is increased by the circulation water pump 8, and the washing water after washing the tableware is retransmitted to the water inlet flow path c, which not only can form a washing water circulation loop, but also can realize the cyclic utilization of the washing water and save water. The circulation water pump 8 is provided in the installation gap b, and the structural layout of the water inlet flow path c is compact, which can reduce the volume of the heat pump dishwasher 100 to a certain extent.

Further, after finishing the washing process, the washing water may be completely discharged. The washing system further includes a drainage flow path d provided in the installation gap b, and a drainage pump 9 is provided at the drainage flow path d. A drainage inlet d1 of the drainage flow path d communicates with the drainage groove 41, so that the washing water can enter the drainage flow path d under the gravity, and the washing water in the drainage groove 41 after finishing the washing process can be completely discharged. The discharged washing water will flow into the drainage pump 9, and the washing water will be quickly discharged by the drainage pump 9. In addition, since the drainage inlet d1 of the drainage flow path d is lower than the condensation water inlet 231 of the condenser 23, after finishing the washing process, the washing water in the condenser 23 can also flow back to the drainage groove 41, and will be discharged through the drainage pipe communicating with the drain outlet d2 of the drainage flow path d, to completely discharge the washing water and prevent the washing water remained in the condenser 23 from affecting the next use.

Figure 9:
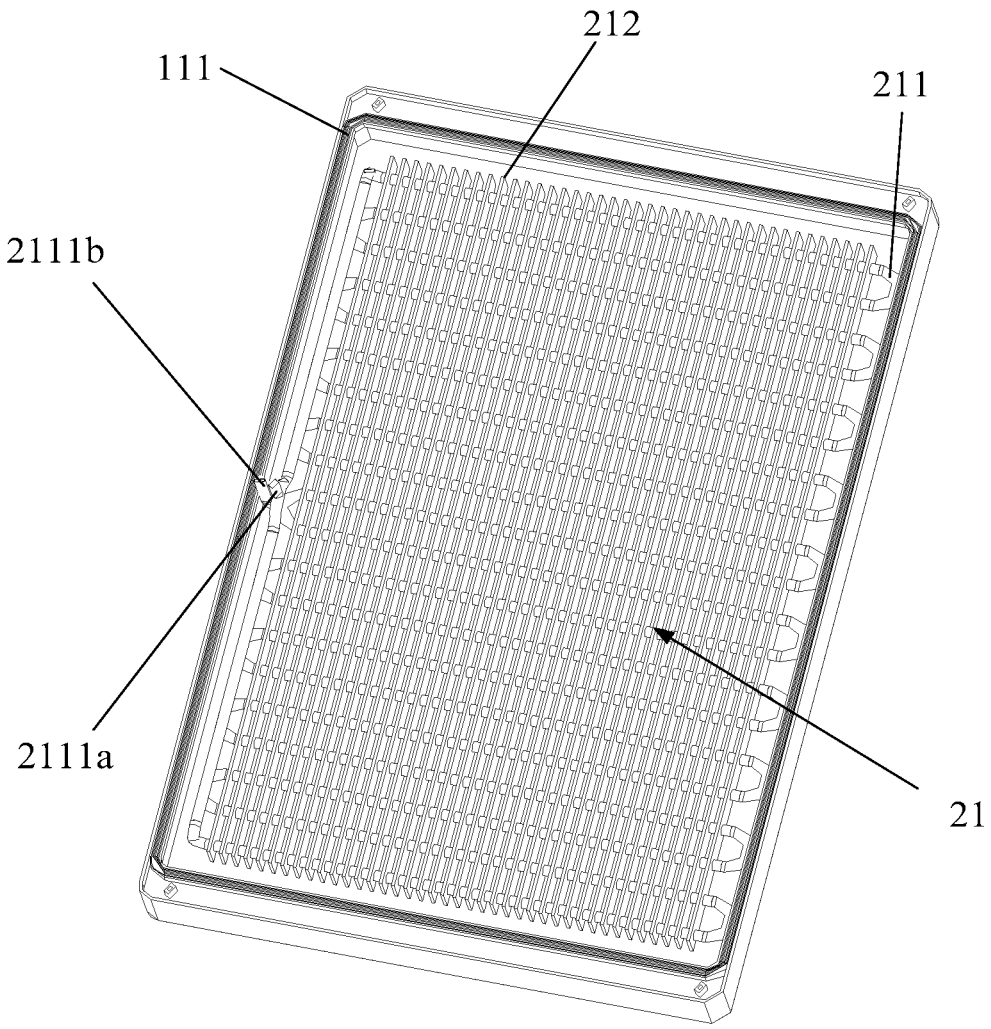
FIG. 9 is a structural schematic view of an evaporator located at the box body in FIG. 2.

Specifically, as shown in FIG. 9, the evaporator 21 includes an evaporator core pipe 211, and at least partial of the evaporator core pipe 211 is submerged in the heat transfer fluid. The evaporator core pipe 211 is distributed in the box body 111, which not only can increase the contact area between the evaporator core pipe 211 and the heat transfer fluid, but also can improve the efficiency of cooling transfer.

Further, the evaporator 21 includes two evaporator core pipes 211, and the two evaporator core pipes 211 are bent back and forth. A first end of the evaporator core pipe 211 communicates with a first end of the other evaporator core pipe 211, to form a refrigerant inlet 2111*a*. A second end of the evaporator core pipe 211 communicates with a second end of the other evaporator core pipe 211, to form the refrigerant outlet 2111*b*. In this way, the time for the refrigerant contacting with the heat transfer fluid during the flowing process can be increased, and the transmitting efficiency of the cooling energy can be improved. The evaporator core pipe 211 is further provided with a heat transfer fins 212, which increases the contact area between the heat transfer liquid and the evaporator 21, and further improves the transmitting efficiency of the cooling energy. The heat pump system further includes a refrigerant circulation flow path 24. Both the refrigerant outlet 2111*b* and the refrigerant inlet 2111*a* communicate with the refrigerant flow path, to realize the refrigerant circulation.

To reduce the volume of the heat pump dishwasher 100, the evaporator 21 is shaped in a plate, so that most part of the evaporator 21 can be submerged in the heat transfer fluid, and the volume of the liquid storage box 11 and the amount of required heat transfer fluid can be reduced to a certain extent. In this way, not only the height of the dishwasher 100 can be reduced and the weight of the bottom of the dishwasher 100 can be increased, but also the center of gravity of the dishwasher 100 can be reduced and the structural stability of the dishwasher 100 can be increased, thereby saving the cost.

As shown in FIG. 1 and FIG. 3, the heat pump system further includes a throttling device 10. The throttling device 10 is located in the installation gap b, and the compressor 22, the condenser 23, the evaporator 21 and the throttling device 10 are provided at the refrigerant circulation flow path 24. When the heat pump system operates, the compressor 22 is used as the driving device to promote the refrigerant circulation in the refrigerant circulation flow path 24. The condenser 23 at the hot end of the compressor 22 heats the water at the water inlet flow path c, thereby increasing the decontamination ability of the washing water. The evaporator 21 will transmit the cold energy to the heat transfer fluid in the box body 111, and provides a compact structure for the heat pump dishwasher 100 described above.

Considering that when the heat transfer fluid absorbs the cooling energy released by the evaporator 21, the phase change of the heat transfer fluid will occur, and the heat transfer fluid will change from liquid to solid. When the heat transfer fluid around the evaporator 21 is solid, the efficiency of the heat transfer fluid absorbing the cooling energy of the evaporator 21 will greatly be reduced. To solve this problem, as shown in FIG. 1, the heat pump dishwasher 100 further includes a heating assembly 101, and the heating assembly 101 is provided at a position corresponding to the box body 111. The heating assembly 101 is used to heat the box body 111, so that the heat transfer liquid in the solid state after absorbing the cold energy can absorb heat and restore to the liquid state, which is convenient for the heat pump dishwasher 100 to operate and absorb the cold energy of the evaporator 21.

Specifically, as shown in FIG. 3, the washing water flow path further includes a water softener 102. The water softener 102 is used to remove calcium and magnesium ions in the water, and the hardness of the washing water can be reduced to soften hard water, thereby avoiding fouling problems of the carbonate on the elements (water pipe, drainage groove 41 and spray arm 7, etc.) in the washing flow path, which can greatly save the cost and ensure the smooth transmission of washing water.

The above are only some embodiments of the present application, and do not limit the scope of the present application thereto. Under the inventive concept of the present application, any equivalent mechanism transformation made according to the description and drawings of the present application, or direct/indirect application in other related technical fields fall within the scope of the present application.

What is claimed is:

1. A heat pump dishwasher, comprising:

a chassis, wherein a liquid collecting groove is provided at an upper side of the chassis; and a heat pump system comprising an evaporator and a compressor, wherein both the evaporator and the compressor are installed at the chassis, and the compressor is installed at the liquid collecting groove, wherein the chassis comprises a liquid storage box, the liquid storage box comprises a box body with an opening facing upward and a cover body for covering the opening, the cover body is partially concave to form the liquid collecting groove, the evaporator is installed inside the box body, the compressor is located outside the box body, and heat transfer fluid is stored in the box body.

2. The heat pump dishwasher according to claim 1, wherein a supporting member is provided at a bottom of the liquid collecting groove, and the supporting member is configured to support the compressor to space the compressor apart from the bottom of the liquid collecting groove.

3. The heat pump dishwasher according to claim 2, wherein a distance between the compressor and the bottom of the liquid collecting groove is L1, and L1 is greater than 0 mm and is not greater than 5 mm.

4. The heat pump dishwasher according to claim 1, wherein an initial liquid level of the heat transfer fluid in the box body is not higher than a lowest point of the cover body.

5. The heat pump dishwasher according to claim 1, wherein an overflow port is provided at the liquid storage box, and the overflow port is higher than a lowest point of the cover body.

6. The heat pump dishwasher according to claim 5, wherein the overflow port is provided at a side wall surface of the box body.

7. The heat pump dishwasher according to claim 1, further comprising:

a washing box body, wherein at least part of the washing box body is supported by an upper end surface of the cover body.

8. The heat pump dishwasher according to claim 7, wherein a sealing ring is provided between a lower end surface of the cover body and the box body.

9. The heat pump dishwasher according to claim 7, wherein:

the washing box body is installed at the upper end surface of the cover body through an installation structure, the installation structure comprises a supporting portion extending upward from the cover body, and an upper end of the supporting portion is configured to abut against the washing box body, to allow an installation gap formed between the washing box body and the cover body, and the compressor is located in the installation gap.

10. The heat pump dishwasher according to claim 9, wherein the installation structure further comprises a connection portion extending vertically, and both ends of the connection portion are respectively connected to a side wall of the washing box body and the supporting portion.

11. The heat pump dishwasher according to claim 7, wherein:

a bottom of the washing box body is provided with a drainage groove;

the heat pump dishwasher further comprises a washing system, and the washing system comprises a water inlet flow path provided in an installation gap;

a water inlet of the water inlet flow path communicates with the drainage groove, a water outlet of the water inlet flow path communicates with a spray arm provided in the washing box body, and a circulation water pump is provided at the water inlet flow path;

the heat pump system further comprises a condenser provided at the water inlet flow path, the condenser comprises a water inlet pipe, the water inlet pipe comprises a condensate water inlet and a condensate water outlet, the condensate water inlet is lower than the condensation water outlet, and the condenser is located between the drainage groove and the circulation water pump; and a bottom of the drainage groove is lower than the condensation water inlet, and the condensation water outlet is lower than a circulation water inlet of the circulation water pump.

12. The heat pump dishwasher according to claim 11, wherein the washing system further comprises a drainage flow path provided at the installation gap, a drainage pump is provided at the drainage flow path, a drainage inlet of the drainage flow path communicates with the drainage groove, the drainage inlet is lower than the condensation water inlet, and a drainage outlet of the drainage flow path communicates with a drainage pipe.

* * * * *